United States Patent [19]

Craig

[11] 4,298,867

[45] Nov. 3, 1981

[54] CATHODE RAY TUBE CHARACTER SMOOTHER

[75] Inventor: Philip V. C. Craig, Hunter, Utah

[73] Assignee: System Concepts, Inc., Salt Lake City, Utah

[21] Appl. No.: 55,688

[22] Filed: Jul. 6, 1979

[51] Int. Cl.[3] ..... G08B 5/36

[52] U.S. Cl. ..... 340/728; 315/386; 340/744

[58] Field of Search ..... 340/728

[56] References Cited

U.S. PATENT DOCUMENTS

| | | | |
|---|---|---|---|
| 3,680,076 | 7/1972 | Duffek et al. | 340/728 |
| 3,697,976 | 10/1972 | Fenton | 340/728 |
| 3,812,491 | 5/1974 | Barraclough et al. | 340/747 |
| 3,894,292 | 7/1975 | Wilkinson et al. | 340/728 X |
| 3,969,716 | 7/1976 | Roberts | 340/728 |
| 4,095,216 | 6/1978 | Spicer | 340/728 |

*Primary Examiner*—David L. Trafton

*Attorney, Agent, or Firm*—Thorpe, North, Western & Gold

[57] ABSTRACT

Disclosed is a cathode ray tube (CRT) character generator system which includes delay apparatus for storing digitally generated raster control signals. Raster control signals thus stored are combined with more recent raster control signals in an analog fashion in order to generate a composite, or interpolated, raster control signal which is resolved in horizontal time increments of finer resolution than that obtainable from the original digitally generated raster control signal. Raster control signals of prior horizontal scan lines are also compared with those of more recent horizontal scan lines in order to detect the steepness of the slope, if any, along the edges of the character to be displayed. A rise-time control signal is generated to control the rise and fall times of the interpolated raster control signal in proportion to this detected slope. The smoothed interpolated raster control signal thus formed turns the sweeping electron beam of the CRT display system on and off in a manner that smooths the sloping character edges that would otherwise appear jagged, or stair-case like.

13 Claims, 14 Drawing Figures

CATHODE RAY TUBE CHARACTER SMOOTHER

BACKGROUND OF THE INVENTION

This invention relates to a method of displaying characters on a cathode ray tube (CRT) screen, and more particularly to a method and apparatus for smoothing the edges of characters thus displayed.

The inside face of a CRT screen is coated with phosphor, or some similar material, that glows when struck by an electron beam. A complete image is assembled on the CRT by "scanning" the screen with such an electron beam. This scanning process may be likened to the manner in which a person reads a page wherein his eyes read one line from left to right, and then drops down one line and read again from left to right. The electron beam inside a CRT scans the screen in much the same way in that the beam moves along horizontal scan lines. When its movement across one horizontal scan line is complete, it drops down to the next horizontal scan line and sweeps across it. In this fashion, the beam scans across the entire face of the CRT screen by sequentially traversing each of the horizontal scan lines that, positioned one below the other, fill the CRT screen.

The electron beam causes a glow or light to appear when it strikes the phosphor coating on the inside of the screen, which glow or light remains present for a short time after the phosphor is struck. Likewise, when the beam is interrupted, the phosphor coating will not glow and the screen appears dark. Because the electron beam moves across the entire screen many times in a fraction of a second, a complete image can be assembled thereon by selectively interrupting this beam as it moves across the various horizontal scan lines.

There are principally three conical signals associated with this image assembling process that must be generated externally to the CRT. First, a horizontal timing signal is needed to move the electron beam at a constant velocity across the horizontal scan lines. Second, a vertical timing signal is required to position the electron beam vertically at the beginning of a new horizontal scan line after an adjacent horizontal scan has been completed. Third, a control signal is needed to selectively interrupt the electron beam as it moves along each horizontal scan line so that only selected areas of the CRT screen will glow, thus creating the desired image. Because the area where the image appears on the CRT screen is commonly termed the "raster", this third signal is often called the "raster control signal", and will be so referred to hereinafter. The invention disclosed herein is concerned with a method and apparatus of timing and shaping the raster control signal when the image to be displayed on the CRT screen is a character (letter, number, or symbol) so as to smooth the edges thereof.

The drawing of FIG. 1 illustrates how the image of a character is assembled on a CRT screen, and will be helpful in explaining the state of the prior art. Shown in the upper portion of FIG. 1 is the image of the character of letter "W" as it might appear on a CRT screen. An electron beam scans across the face of the CRT from left to right along horizontal scan lines 101, starting with scan line 0. At the completion of scan line 0, the electron beam returns to the left and simultaneously drops down one line to begin its left to right movement along scan line 1. Thus, the path of the electron beam follows a zig-zag path down the face of CRT as represented by line A—A.

As the electron beam moves along each horizontal scan line, raster control signals 103, shown in the lower portion of FIG. 1, are generated to selectively inhibit the electron beam from striking the CRT phosphor coated screen, thereby creating selective dark areas thereon. These raster control signals 103, one corresponding to each horizontal scan line 101, are represented in FIG. 1 as a low signal when the electron beam is to be off (inhibited, or dark screen), and a high signal when it is to be on (not inhibited, or a light screen). Thus, the raster control signal corresponding to horizontal scan line zero (0) is a low signal for the entire time it takes the electron beam to move horizontally across the scan line because the CRT screen is to remain dark for the entire length thereof. In contrast, the raster control signal corresponding to horizontal scan line 1 is switched to a high signal at time $t_1$, which time corresponds to point $p_1$ on the CRT screen, and is likewise switched to a low signal at time $t_2$, corresponding to point $p_2$. This process causes the screen to appear light between points $p_1$ and $p_2$, thus creating the upper left-hand edge of the character "W". Likewise, the raster control signal is switched from low to high at time $t_3$ of its horizontal sweep across scan line 1, and from high to low at time $t_4$, in order to cause the upper righthand edge of the "W" to appear on the CRT screen. In a similar fashion, the raster control signal is used to selectively switch the electron beam "on" and "off" ("not inhibited" or "inhibited", respectively) as it scans along each horizontal scan line, thereby causing the screen to become light only during those selective portions of each scan line that constitute segments of the character "W". (Not shown in FIG. 1 are the blanking signals used to keep the electron beam inhibited during its diagonal return from the end of one scan line to the beginning of another.)

As the prior art drawing of FIG. 1 illustrates, a character displayed by the process described above will have "jagged" or "stair-stepped" edges. This is because the raster control signals are typically generated using digital techniques, i.e., employing a memory to store information defining which segments of each horizontal scan line are to appear light for each of the possible characters that can be displayed. Such techniques, by their very nature, segment each horizontal scan line into bits or fragments that must either be light or dark. The width of these "bits" is termed the character resolution time, and is illustrated in FIG. 1 as time "$T_c$". Digital techniques also cause the raster control signal to turn on and off sharply, even when a character edge is oblique to vertical. Such edges appear "stair-stepped" even when $T_c$ is diminished toward zero.

The prior art employs two basic methods to smooth the "jagged" or "stair-stepped" edges that are inherent in characters displayed on CRT screens by the method described above. The first is simply to decrease the character resolution time, $T_c$. The prior art drawing of FIG. 2 illustrates the effect that a reduction in $T_c$ can have. Theoretically, of course, $T_c$ can be made smaller and smaller until the human eye can no longer perceive the jagged edges appearing on the sloping edges of the character. This first approach yields excellent results for steep sloping edges, but the method of making $T_c$ very small is very expensive to implement. This added expense results primarily from the increased memory, and corresponding increased amount of circuitry, that the smaller-character-resolution-time approach requires in order to "remember" what each smaller segment of each horizontal scan line is supposed to be—light or dark. Moreover, unless the character resolution time is made extremely small, the undesirable stair-step edges remain, only on a smaller scale. Also, unless the density of horizontal scan lines is greatly increased, the jaggedness of slopes oblique to vertical is not diminished by reducing $T_c$.

The second method used in the prior art to smooth the inherent jagged edges of CRT displayed characters is to pass the raster control signal through a low pass filter prior to allowing it to control the electron beam. The low pass filter, of course, removes all the high frequencies from the signal, thus rounding out its corners and decreasing its rise and fall times. This low pass filter approach is simple to implement, but unfortunately the absence of the high frequencies prevents the raster control signal from sharply turning the electron beam on or off. The result is a smudged look, i.e., the character appears as though it is out of focus.

OBJECTIVES OF THE INVENTION

It is the primary object of the present invention to provide an apparatus and method that will smooth the jagged or stair-stepped edges that are inherently present in a digitally generated character displayed on a CRT or similar device.

It is another object of the present invention to achieve the character smoothing function without the necessity of externally decreasing the character resolution time or altering the existing character generation circuitry in any way.

It is a further object of the present invention to achieve the character smoothing function in a simple yet effective manner, without blurring or smudging of the character edges.

An additional object of the present invention is to provide a character smoothing appratus which may be easily added as a detachable option to any existing CRT display screen, or which may just as easily be included as an integral part of a newly fabricated system.

SUMMARY OF THE INVENTION

The preceding and other objects of the invention are realized in the following specific illustrative embodiment thereof. Given a conventional CRT-type system designed to display characters with a character resolution time, $T_c$, such that the sloping edges of the displayed characters would normally appear jagged or stair-stepped, the present invention smooths those jagged or stair-stepped edges in the manner summarized below.

First, the raster control-signal, which signal is normally sent directly to the CRT to control the pattern and sequence with which the electron beam is allowed to light up the CRT screen, is delayed for various combinations of two time increments. The first delay time increment is the character resolution time, $T_c$. The second delay time increment is the total time it takes the electron beam to sweep across and return from one horizontal scan line, which time will be hereinafter termed the sweep time, or $T_s$. Delaying the raster control signal for combinations of these two times effectively serves as a storage means and permits a combination or comparison of a present raster control signal (corresponding to a present horizontal scan-line) with that of a previous raster control signal (corresponding to a prior horizontal scan line).

Second, a unique combination of positive and negative pulses is generated for each positive or negative transition of the raster control signal, or delayed raster control signals, by a plurality of transition detector circuits. Each of these circuits produces a tri-level output—positive pulse, no pulse, or a negative pulse. These pulses are then added and limited in analog fashion so as to produce a positive and negative going box-car shaped signal that contains information relative to the transitions that occurred in the raster control signal over the last several horizontal scan lines.

Third, a transition occurring in a specified raster control signal is used to trigger a ramp signal that lasts $T_c$ seconds. If the particular transition triggering the ramp signal is positive (CRT screen changing from dark to light), then the ramp signal is a positive going ramp signal. Likewise, if the transition triggering the ramp signal is negative (CRT screen changing from light to dark), then the ramp signal is a negative going ramp signal.

Fourth, the box-car shaped signal is compared with the ramp signal by a voltage comparator circuit. The output of the voltage comparator circuit is a two-level signal which is low when the voltage of the ramp signal is less than the voltage of the box-car shaped signal and high when the opposite condition exists. The effect of the voltage comparator circuit responding to its input signals in this fashion is to create a delayed raster control signal whose transitions may occur at times other than increments of $T_c$ and whose delay is a function of transitions that occurred in the raster control signals over the last several scan lines. That is, the amount of delay is based on an interpolation of present and past information contained in the raster control signals. Hence, this signal is termed an interpolated raster control signal; and, in combination with other interpolated raster control signals, it has the same effect on the displayed characters as would decreasing the character resolution time $T_c$, i.e., the width of the displayed character's jagged or stair-stepped edges is decreased or reduced to zero.

Fifth, the delayed raster control signals corresponding to adjacent and subadjacent horizontal scan lines are compared in order to determine the amount of slope that would appear in the edge of the displayed character if generated by said delayed raster control signals. This slope is measured by measuring the number of $T_c$ increments between the time the raster control signal of one horizontal scan line inhibits or enables the sweeping electron beam and the time the raster control signal of an adjacent or subadjacent horizontal scan line correspondingly inhibits or enables the electron beam. In other words, the width of the jagged edge or stair-step that would appear on an edge of the displayed character is measured in $T_c$ increments.

Once measured, the value of the width of the jagged edge is stored in a register or other storage medium and is thereafter used to generate an analog rise-time control signal. This rise-time control signal is directed to a rise-time control circuit through which the interpolated raster control signal must pass. The rise and fall times of the interpolated raster control signal are modified by this rise-time control circuit in accordance with the rise-time control signal. The end result is that the rise and fall times of the interpolated raster control signal are made proportional to the width of the jagged edge that would normally appear on the displayed character. The effect of having controlled rise and fall times on the raster control signal is to allow the electron beam that strikes the phosphor CRT screen to vary in intensity so as to gradually change the screen from light to dark, or dark to light, said gradual change occurring within a time that is proportional to the secant of the slope of the character edge, relative to vertical. This process creates the appearance of a smooth sloping edge when the character is ultimately displayed on the CRT screen.

In summary, the present invention achieves two main goals over the prior art. First, it generates an interpolated raster control signal that produces the same beneficial effects as would decreasing the character resolution time, $T_c$, but which is achieved without the added cost or inconvenience (increased memory, modifying the character generation circuitry to include faster clock rates, additional logic, etc.) that the prior art would require. Second, it smooths the rise and fall times of this interpolated raster control signal in proportion to the width of the jagged character edge, thereby eliminating the narrower stair-step edges that would otherwise appear, and replacing them with a smooth sloping edge.

BRIEF DESCRIPTION OF THE DRAWINGS

The above and other objects, features and advantages of the invention will be more apparent from the following more particular description of a preferred embodiment of the invention, as illustrated in the accompanying drawings in which:

FIGS. 5A through 5E show exemplary timing sequence diagrams that illustrate the order in which key signals and events related to FIG. 4 occur, while

DETAILED DESCRIPTION OF THE INVENTION

The following detailed description is concerned with an application of the invention used in a CRT character display system. However, the invention is not limited to use in a CRT character display system, and other applications of the invention, such as with any display mechanism, present or yet to be devised, which employs horizontal and vertical positioning means, as well as a ligh/dark control means to control which portion of the horizontal position means are to appear light or dark, are possible.

Figure 1:
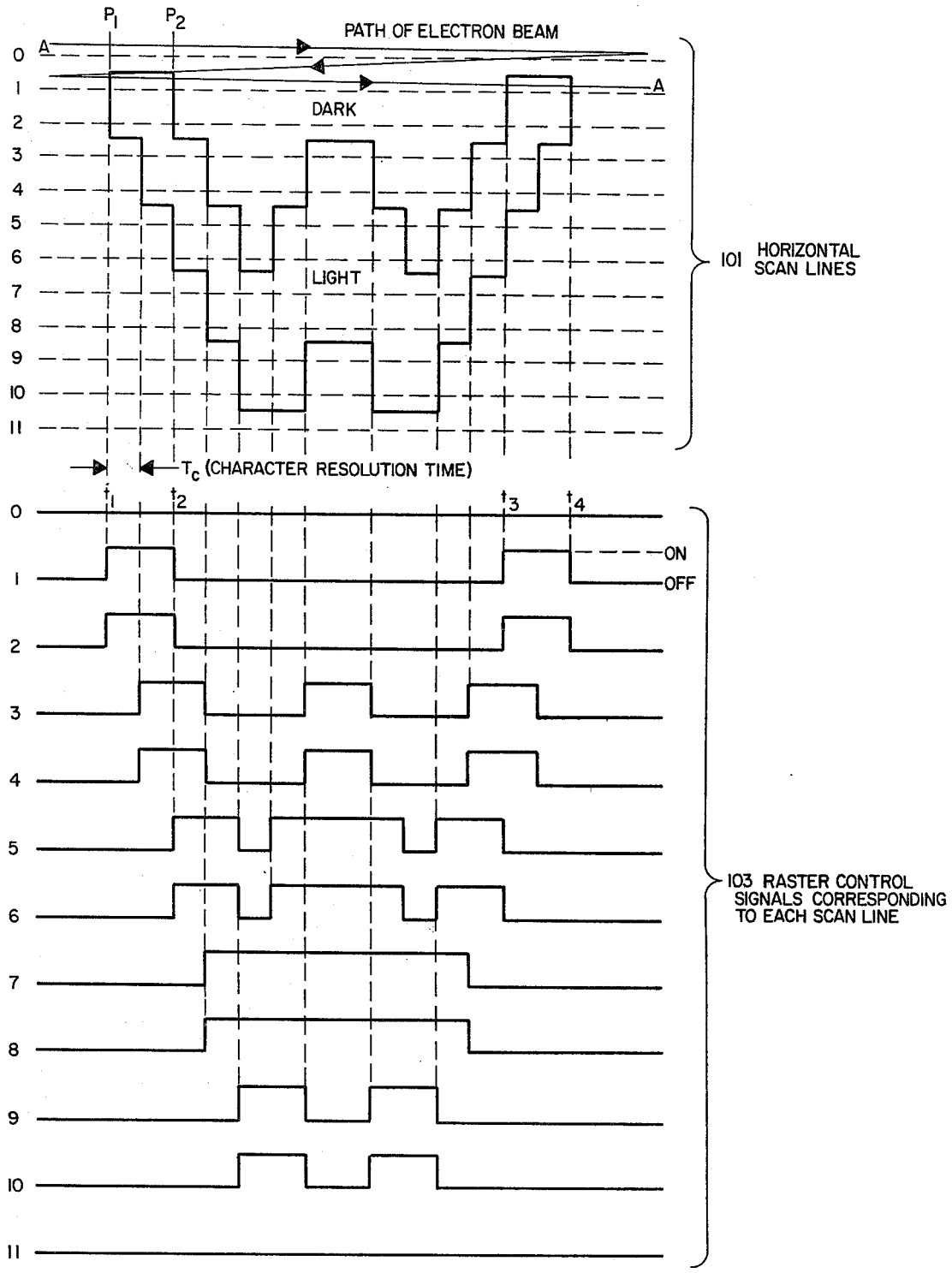
Fig. 1 (PRIOR ART)
FIG. 1 is a prior art drawing illustrating how the character "W" might be generated and displayed with a prior art CRT system, and was discussed above in the BACKGROUND OF THE INVENTION.
Figure 2:
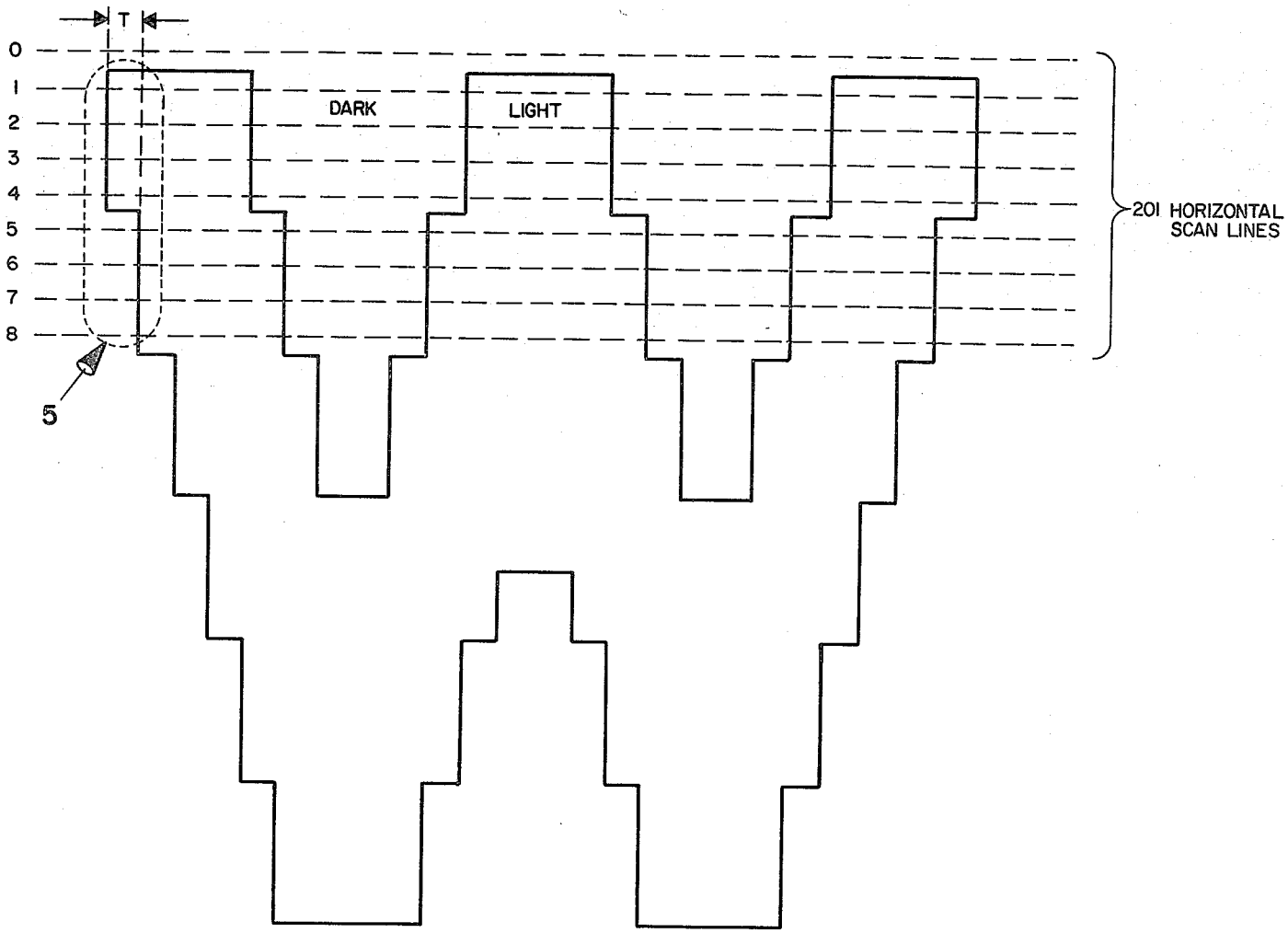
Fig. 2 (PRIOR ART)
FIG. 2 is also a prior art drawing illustrating one method the prior art uses to improve the resolution of the displayed character by decreasing the character resolution time, and was likewise discussed above in the BACKGROUND OF THE INVENTION, although the upper left hand corner of FIG. 2 may further serve as a key to the timing sequence diagrams of FIG. 5.

Referring now to the drawings, FIG. 1 and FIG. 2 are prior art drawings, previously discussed in BACKGROUND OF THE INVENTION, illustrating how the prior art might generate and display the character "W" (FIG. 1), and how the prior art might improve the resolution thereof by decreasing the character resolution time (FIG. 2). Both FIG. 1 and FIG. 2 clearly illustrate the undesirable jagged edges or stair-step appearance that occurs in the sloping edges of the displayed character. It is, of course, the primary goal of the invention disclosed herein to eliminate this jagged or stair-stepped appearance, and to ultimately display a character whose sloping edges are smooth, but not blurred.

Figure 3:
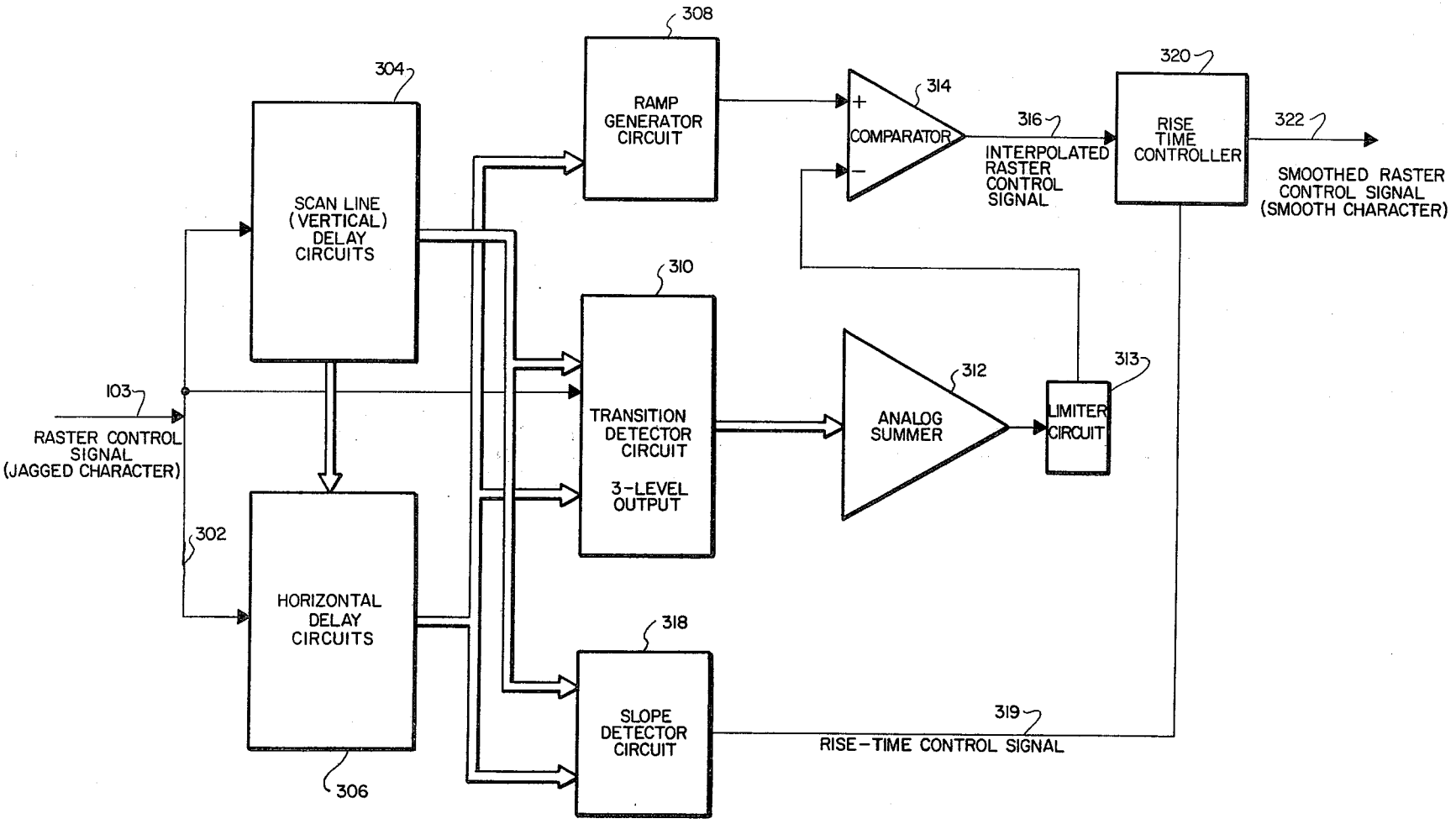
FIG. 3 shows a block diagram schematic of a circuit made in accordance with the principles of the present invention.

Referring now to FIG. 3, there is illustrated a block diagram schematic showing one embodiment of the invention. A raster control signal 103 of a present horizontal scan line 101 (FIG. 1) serves as the invention's key input signal. This input signal represents, in combination with similar raster control signals from other horizontal scan lines, a jagged character; and it is this input signal 103 which must be more finely resolved and decreased in transitional risetime in order to ultimately display a smooth character.

The raster control signal 103 is sent over an input signal line 302 to a plurality of scan line delay circuits 304, a plurality of horizontal delay circuits 306, and a transition detector circuit 310. The scan line delay circuits 304 delay the raster control signal in increments of the horizontal sweep and return time, $T_s$. (Because the CRT's sweeping electron beam progresses vertically down the screen from one horizontal scan line to the next lower horizontal scan line in $T_s$ seconds, these scan line delay circuits 304 may be referred to as vertical delay circuits.) The horizontal delay circuits 306 delay the raster control signal in increments of the character resolution time, $T_c$.

The delayed outputs of the scan line delay circuits 304 and the horizontal delay circuits 306 are routed to the transition detector circuit 310. The transition detector circuit 310 responds to these delayed signals, as well as to the non-delayed raster control signal 103, and produces a 3-level output signal composed of positive pulses, negative pulses, or no pulses as a function of the transitions appearing on these various input signals. These 3-level output signals thus generated are added in an analog summing circuit 312, the output of which is bounded to maximum and minimum levels by a limiter circuit 313.

One delayed raster control signal from the horizontal delay circuits 306 is also routed to a ramp generator circuit 308. It is the function of the ramp generator circuit 308 to produce a ramp signal that always begins at a time set by its input signal. In the preferred embodiment of the invention herein disclosed, the ramp signal is always triggered by a raster control signal that has been delayed $2T_s+T_c$ seconds. The ramp signal thus triggered is a voltage that linearly changes from a minimum voltage to a maximum voltage (positive-going ramp signal), or from a maximum voltage to a minimum voltage (negative-going ramp signal), in $T_c$ seconds. The polarity (positive-going or negative-going) of the ramp signal corresponds to the polarity of the transition in the delayed raster control signal that triggered it.

The output signals from the ramp generator circuit 308 and the limiter circuit 313 are compared at a voltage comparator circuit 314. The ramp signal is connected to the positive input of the voltage comparator 314 so that the output thereof is low whenever the voltage of the ramp signal is less than the voltage of the signal from the limiter circuit 313. Similarly, the output of the voltage comparator 314 is high whenever the voltage of the ramp signal is greater than the voltage of the output signal from the limiter circuit 313. The signal thus formed is termed the interpolated raster control signal 316 and is applied to a rise time controller 320.

Still referring to FIG. 3, it is seen that the delayed output signals from the scan line delay circuits 304 and the horizontal delay circuits 306 are also connected to a slope detector circuit 318. It is the function of slope detector circuit 318 to compare the delayed raster control signals of adjacent and subadjacent horizontal scan lines in order to determine the width, measured in increments of $T_c$ seconds, of corresponding jagged steps that, but for the smoothing effect of the invention herein disclosed, would otherwise appear in the displayed character. Once the width of the jagged edge is thus measured, a rise-time control signal 319 is generated as a function thereof, which control signal is applied to the rise-time controller 320.

The rise-time controller 320 modifies the rise and fall times of the interpolated raster control signal 316 in accordance with the rise-time control signal 319. These modified rise and fall times are proportional to the width of the jagged edge step as measured by the slope detector circuit 318. Thus, a wide jagged edge step (several $T_c$ increments) results in a slow rise or fall time; and a narrow jagged edge (e.g., one $T_c$ increment) results in a fast rise or fall time. Thus formed, the output signal of the rise time controller 320, termed a smoothed raster control signal 322, is sent to the CRT, and represents, in combination with similar smoothed raster control signals corresponding to other scan lines, a smoothed character—which is the desired result of the invention herein disclosed.

Figure 4:
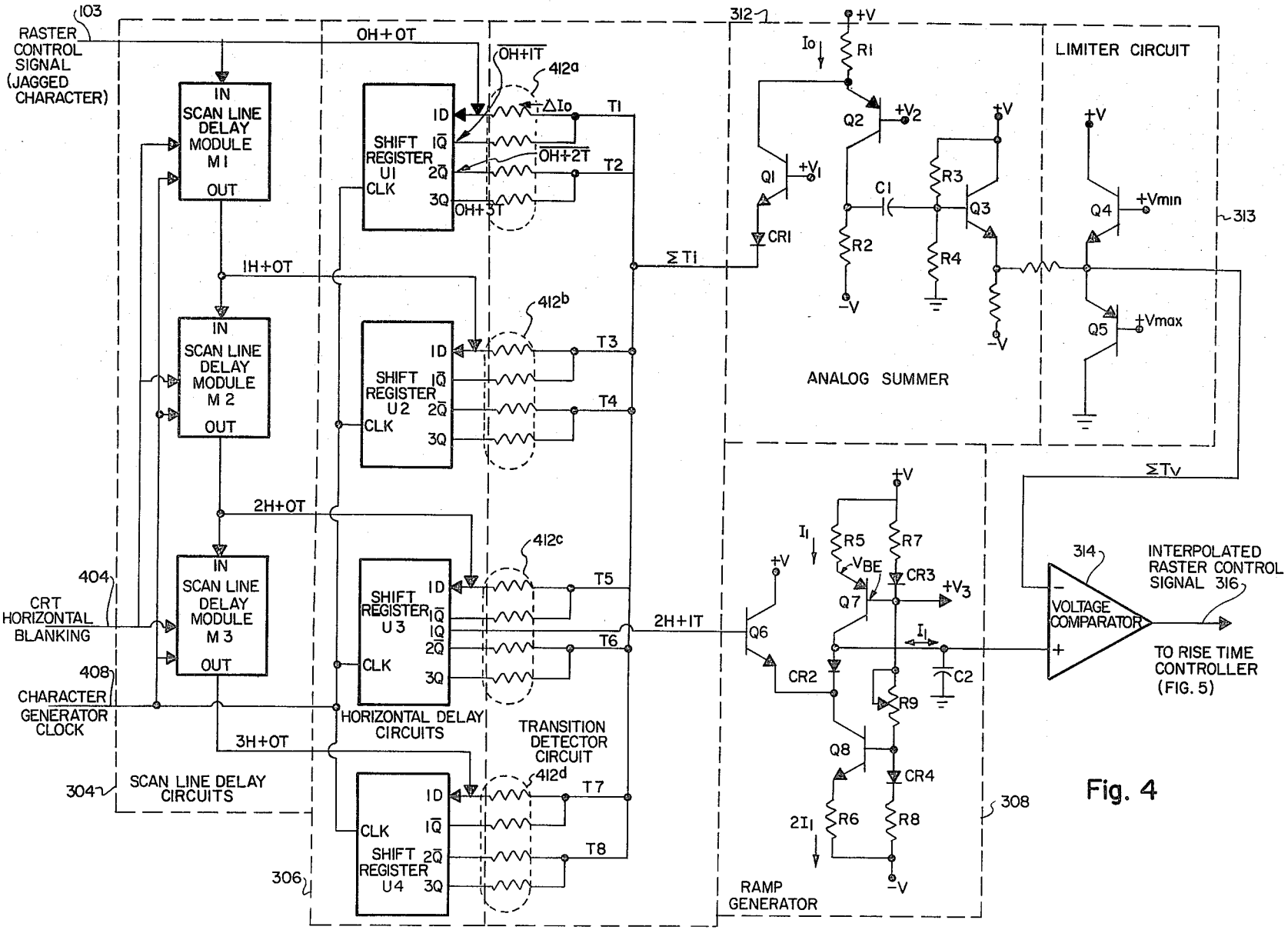
FIG. 4 shows exemplary circuitry for the scan line delay circuits 304, the horizontal delay circuits 306, the ramp generator circuit 308, the transition detector circuit 310, the analog summer 312, the limiter circuit 313, and the comparator 314 of FIG. 3.

Referring now to FIG. 4, there is shown exemplary circuitry of all the elements shown in FIG. 3 except the slope detector circuit 318 and the rise-time controller 320. Scan-line delay modules M1, M2, and M3, delay the input raster control signal 103 in increments of $T_s$ seconds, the horizontal scan-line cycle time. Similarly, shift registers U1, U2, U3, and U4 generate delays in increments of $T_c$ seconds, the character resolution time. Thus, in combination, delay modules M1, M2, and M3 constitute the scan line delay circuits 304 of FIG. 3, while shift registers U1, U2, U3, and U4 constitute the horizontal delay circuits 306. In the preferred embodiment of the invention,the scan-line delay modules M1, M2, or M3 may be easily realized by one skilled in the art using commercially available integrated circuits to digitally delay the input signals thereof for one horizontal scan-line cycle time, using a horizontal blanking signal 404 from the CRT as a reset signal, and a character generator clock 408, from character generation circuitry (used to generate the raster control signals 103), as a clock signal. Similarly, shift registers U1, U2, U3, or U4 may be realized with a commercially available 74175-type shift register (four D-type flip-flops), clocked by the character generator clock 408. Alternatively, delay modules M1, M2, and M3 could be realized using commercially available ultrasonic glass delay lines, and shift registers U1, U2, U3, and U4 could be replaced with commercially available "LC" delay lines or ramp delay devices. Such alternative realizations would preclude the need for using the CRT horizontal blanking signal 404 or the character generator clock 408 as timing signals.

As FIG. 4 shows, the raster control signal 103 is supplied as an input to delay module M1 and to shift register U1. Because this signal at this point has not been delayed by either $T_s$ or $T_c$, it is labeled "$\phi H+\phi T$". This labeling scheme will be used hereinafter to indicate the amount of delay present in any given signal. The number preceding the letter "H" indicates the number of $T_s$ increments, or horizontal scan-lines, by which the signal has been delayed. The number preceding the letter "T" indicates the number of $T_c$ increments, or character resolution times, by which the signal has been delayed within a given scan line. Thus, the designation "$\phi H+3T$" would indicate a signal which had been delayed zero scan-lines plus three character resolution times.

FIG. 4 shows that the output of delay module M1 is a signal "$1H+\phi T$" and that this signal is applied as an input to delay module M2 and to shift register U2. Similarly, the outputs of delay modules M2 and M3, "$2H+\phi T$" and "$3H+\phi T$" respectively, are applied as inputs to shift registers U3 and U4 respectively. In this fashion, a whole series of delayed signals, $mH+\phi T$ are generated, where $m=0$, 1, 2, or 3.

As FIG. 4 indicates, "$mH+nT$" signals, where $n=0$, 1, 2, or 3, are produced by the shift registers U1 through U2 and applied to various resistor networks **412*a*, 412*b*, 412*c* or 412*d*. Thus, signals $\phi H+nT$ are tied together by resistor network 412*a*, composed of 4 resistors of equal value. Similar resistor networks 412*b*, 412*c*, and 412*d* are used to tie together the "$1H+nT$", "$2H+nT$", and "$3H+nT$" signals respectively. These register networks comprise, in the preferred embodiment herein disclosed, the transition detector circuit 310. The operation of the transition detector circuit 310 is best understood by considering the operation of the analog summer 312** in connection therewith.

The analog summer 312, as shown in FIG. 4, contains a constant current source comprised of transistor Q2, resistor R1, and a reference voltage source $+V_2$. The constant current, $I_o$, generated by these components is shared between two branches of the circuit. The first branch directs a portion of $I_o$ through transistor Q1 and diode CR1 to a common tie point, labeled $\Sigma T_i$, of the resistor networks **412*a*, 412*b*, 412*c*, and 412*d*. These resistor networks, in combination, constitute the equivalent of a first load resistor. The second branch directs the remaining portion of $I_o$ through transistor $Q_2$ to a second load resistor R2. The voltage developed across resistor R2 by this remaining portion of $I_o$ is thus a function of the amount of current flowing through the first branch of the circuit to the common tie point $\Sigma T_i$ of the resistor networks. The ends of the resistor networks not tied to the common $\Sigma T_i$ tie point, are connected to various outputs of the horizontal delay circuits (shift registers) U1, U2, U3 and U4 and the outputs of the delay modules, M1, M2, and M3. In the preferred embodiment of the invention, these outputs are TTL (transistor-transistor logic) compatible, which means they either provide a path for current to flow to ground or they do not, depending upon whether the particular output signal is a logical zero ("low" signal—current flows to ground) or a logical one ("high" signal—current does not flow). Thus, the amount of current that flows from the $\Sigma T_i$ common tie point to ground is a function of the number of logical "zeros" appearing at the outputs of the delay circuits, including the non-delayed raster control signal 103 (which is presumed to also originate from a TTL circuit). Because the $\Sigma T_i$ common tie point is clamped to a constant voltage by the reference voltage $+V_1$ appearing at the base of transistor Q1, and because each of the resistors in the resistor networks 412***a*, 412*b*, 412*c*, and 412*d* are of the same value, the amount of current, $\Delta I_o$, that flows through any leg of the resistor networks to a logical zero (ground) signal level is fixed. A subsequent change in the signal level from a logical zero to a logical one will prevent that fixed amount of current $\Delta I_o$ from flowing through the Q1 branch of the analog summer 312. Accordingly, the current through the Q2 branch will increase by $\Delta I_o$, producing a corresponding voltage increase across resistor $R_2$. In a like fashion, a change in the signal level from a logical one to a logical zero at any of the outputs of the delay circuits, or the non-delayed raster control signal 103, will cause the current flowing through resistor R2 to decrease by $\Delta I_o$, thereby causing a corresponding voltage decrease thereacross. The resistance of R2 is one-fourth that of each resistor of the transition detector circuit 310. Thus, the voltage change across R2 equals one-fourth of that applied to a resistor of the transition detector circuit 310.

In the above-described manner, all of the transitions occurring in the raster control signal, or signals delayed therefrom, are detected. The resulting voltage developed across resistor R2 represents the sum of all the transitions that occur. This voltage is passed through a buffer stage, comprised of transistor Q3, bias resistors R3 and R4, and coupling capacitor C1, and clamped to maximum and minimum voltages by the limiter circuit 313 comprised of transistors Q4 and Q5. The maximum and minimum voltage levels, as set by reference voltages $+V_{MAX}$ and $+V_{MIN}$, are selected such that the output signal of the analog summer, $\Sigma T_v$, is limited at that voltage level corresponding to a change in current of $2\ \Delta I_o$ through resistor R2.

Also shown in FIG. 4 is the ramp generator circuit 308. Ramp generating means are employed to force a constant current $I_1$ to flow into or out of a charging capacitor C2 for each positive or negative transition of a triggering signal, "2H+1T". By setting the voltage at the base of a transistor Q7 to a desired reference voltage $+V_3$, the voltage at the emitter of Q7 is also set at this same voltage, less the base-emitter voltage drop, $V_{BE}$, of Q7. Thus, a fixed voltage is developed across resistor R5, forcing a constant current $I_1$ to flow therethrough. Diode CR3 is used to maintain a constant voltage across R5 by compensating for temperature variations of $V_{BE}$. In a similar fashion, a constant current of $2I_1$, is forced to flow through a resistor R6 and a transistor Q8.

In the quiescent state of the ramp generator circuit 308 (no ramp signal being generated), an additional current equal to $I_1$ is pulled through a transistor Q6 and added to the constant current $I_1$ flowing through R5 and Q7 in order to equal the $2I_1$ constant current value which must flow through transistor Q8 and resistor R6. When a positive transition appears on the "2H+1T" signal, diode CR2 is back-biased forcing the constant current $I_1$ generated by R5 and Q7 to flow into the charging capacitor C2. Because the voltage across any capacitor is proportional to the integral with respect to time of the current flowing therein, the voltage across the capacitor linearly increases with time (i.e., a positive ramp signal) until diode CR2 is no longer back-biased, at which time the ramp generator circit 308 returns to its quiescent state of operation. (While CR2 is back-biased, the constant current $2I_1$ that must flow through resistor R6 is pulled through transistor Q6.)

Similarly, when a negative transition appears on the "2H+1T" signal, the base-emitter junction of transistor Q6 is back biased, thereby turning Q6 off. With Q6 off, the $2I_1$ constant current source forces an additional $I_1$ current to flow out of the charging capacitor C2, thereby causing the voltage across the capacitor to linearly decrease with time (i.e., a negative ramp signal) until transistor Q6 is no longer back-biased, at which time the ramp generator circuit 308 again returns to its quiescent state. In the preferred embodiment of the invention, the value of $I_1$ may be adjusted by changing variable resistor R9 until the ramp time is just equal to the character resolution time, $T_c$.

The voltage comparator 314 is realized using a commercially available voltage comparator integrated circuit, such as an LM 311, manufactured by National Semiconductor, Inc.

The operation of the circuits shown in FIG. 4 will now be explained in light of the timing sequence diagrams of FIG. 5. These timing sequence diagrams illustrate the operation of FIG. 4 for a dark to light transition on the CRT screen. The circuits of FIG. 4 operate identically for a light to dark transition except that all the waveform polarities shown in the timing sequence diagrams of FIG. 5 are inverted.

Shown at the top of each of the timing and sequence diagrams of FIG. 5 is a key to indicate where along each of a series of numbered horizontal scan lines the transition from light to dark occurs. This key may be compared with the circled area shown in FIG. 2 in order to see what portion of an overall character the timing sequence diagrams of FIG. 5 could depict. For example, FIG. 5A shows the timing and sequence diagram of the key signals corresponding to a present raster control signal, "$\phi H+\phi T$", for scan line 4. There have been no stepped edges appearing in the previous 3 horizontal scan lines, but a stepped edge is coming up in horizontal scan line 5. Thus, FIG. 5A depicts the status of the key signals that exist when the transition from dark to light over the last several horizontal scan lines displays a vertical edge.

Figure 5A:
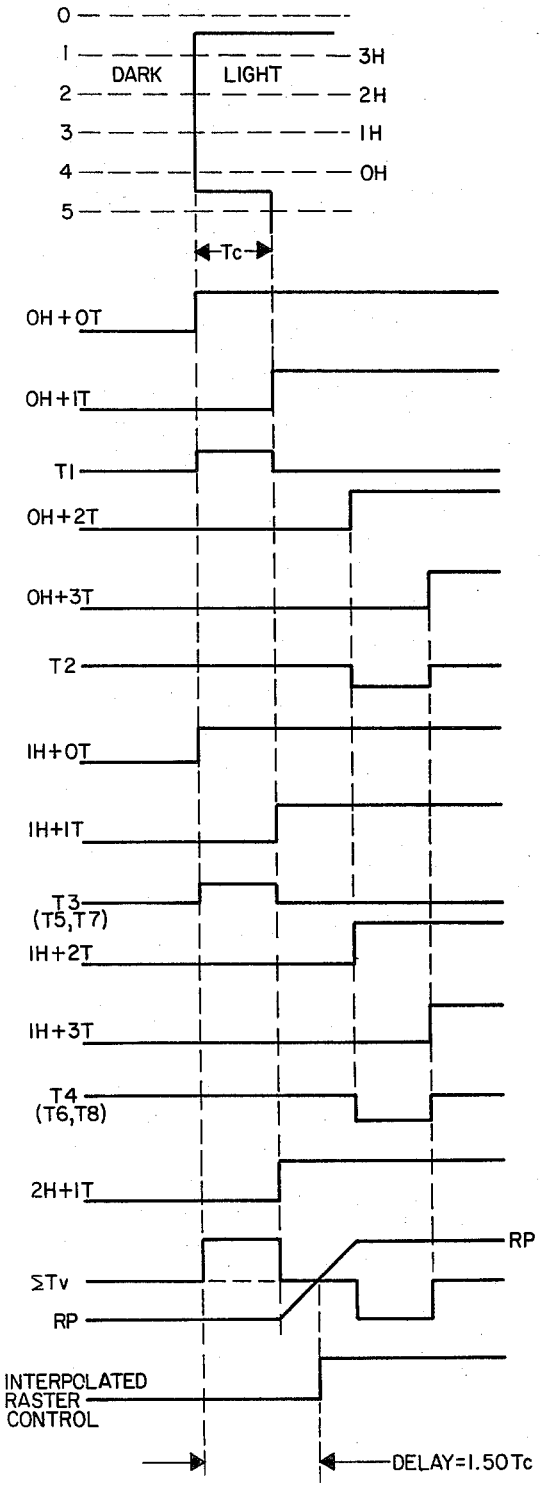

As shown in FIG. 5A, a positive pulse designated $T_1$ is generated from the $\phi H+\phi T$ and $\phi H+1T$ signals. Similarly, a negative pulse designated T2 is generated by the $\phi H+2T$ and $\phi H+3T$ signals. An examination of FIG. 4 reveals the process by which these pulses are generated. A first resistor of the network 412*a* is connected directly to the $\phi H+\phi T$ raster control signal source. A second resistor of this same network is connected to the inverse of the $\phi H+1T$ signal source, $\overline{\phi H+1T}$. These two resistors are then tied together at the point labeled $T_1$. Before the transition occurs in the $\phi H+\phi T$ signal, the signal source from which this signal originates is a logical zero, and is therefore sinking $\Delta I_o$ current as explained previously. The source of the $\overline{\phi H+1T}$ signal, however, is at a logical one level, and is therefore not sinking any current. As soon as the positive transition occurs in the $\phi H+\phi T$ signal, the $\Delta I_o$ being sunk into the source thereof is switched off, forcing an additional $\Delta I_o$ of current to flow through R2, thus generating a positive voltage pulse. As soon as the $\overline{\phi H+1T}$ signal goes to a logical zero level, one $T_c$ time after the transition of the $\phi H+\phi T$ signal, then the source of the $\overline{\phi H+1T}$ signal sinks $\Delta I_o$ current, causing the current through resistor R2 to decrease by that amount, thereby returning the voltage to its prior level. In a similar manner, a negative pulse T2 is generated from the $\overline{\phi H+2T}$ and the $\phi H+3T$ signals.

This process—of generating a positive pulse followed by a negative pulse—also occurs for every positive transition appearing in the delayed raster control signals, $nH+\phi T$, where n=1, 2, or 3, generating positive pulses T5 and T7, and negative pulses T6 and T8. It is important to realize that at the point labeled $\Sigma T_i$ in FIG. 4, these signals are current pulses (hence, the subscript "i"), the voltage thereat being clamped to a constant value by the reference voltage $+V_1$. But at the output of the analog summer 312, prior to the limiter circuit 313 (which point is the emitter of transistor Q3), these signals have been converted to voltage pulses.

For the condition shown in FIG. 5A, all of the positive pulses, T1, T3, T5, and T7, occur at the same time, and therefore add to form a large positive pulse. Similarly, all of the negative pulses, T2, T4, T6, and T8, add to form a large negative pulse. The limiter circuit 313 then limits these large positive and negative pulses to a value of twice that of a single positive or negative pulse. The resulting box-car shaped signal, $\Sigma T_v$, is then routed to the negative input port of the voltage comparator 314.

FIG. 5A also illustrates the ramp signal that is generated by the ramp generator circuit 308 in the manner described previously. This ramp signal, labeled RP-RP in FIG. 5A, is triggered by the 2H+1T transition, and is routed to the positive input port of the voltage comparator 314.

When the voltage of the ramp signal exceeds that of the $\Sigma T_v$ signal, then the output of the voltage comparator 314 switches from a low to a high signal. As FIG. 5A shows, this signal, termed the interpolated raster control signal, is delayed 1.5 $T_c$ increments from the original $\phi H+\phi T$ signal. (Actually the delay is 2 $T_s$+1.5 $T_c$ since the ramp signal is always triggered, as previously discussed, by a raster control signal which has been delayed two sweep times $T_s$ [caused by delays of the scan-line delay modules $M_1$ and $M_2$] plus one resolution time $T_c$. The additional delay of two sweep times will be understood even though not specifically stated in discussions hereafter of the generation of other interpolated raster control signals.

Figure 5B:
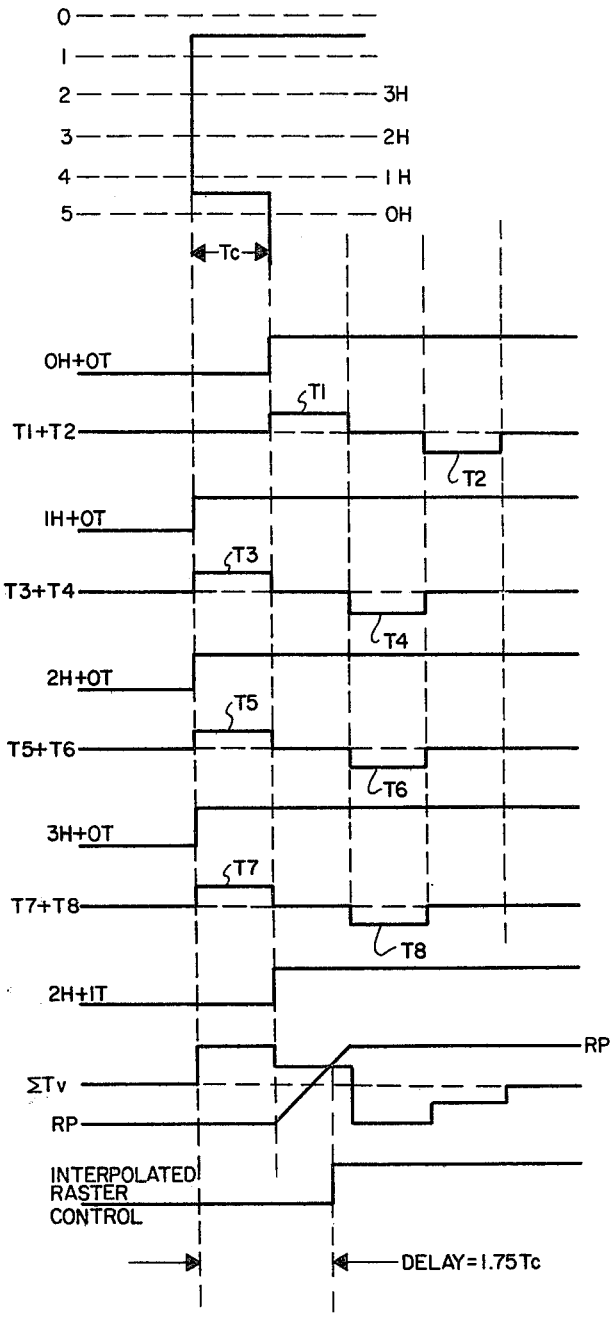

FIG. 5B illustrates the same process as that described in FIG. 5A except that the present raster control signal, $\phi H+\phi T$, corresponds to horizontal scan line 5, on which a stepped or jagged edge occurs in the display of the character. This jagged edge causes the $T_1$ and $T_2$ positive and negative pulses to be delayed one character resolution time from the remaining position and negative pulses, resulting in a $\Sigma T_v$ signal that is stair-stepped, as shown in FIG. 5B. The point at which the ramp signal exceeds that of the $\Sigma T_v$ signal, and hence the point at which the interpolated raster control signal switches from dark to light, occurs 1.75 $T_c$ increments from what was the original $\phi H+\phi T$ signal (delayed in FIG. 5B to the 1H+$\phi$T signal).

Figure 5C:
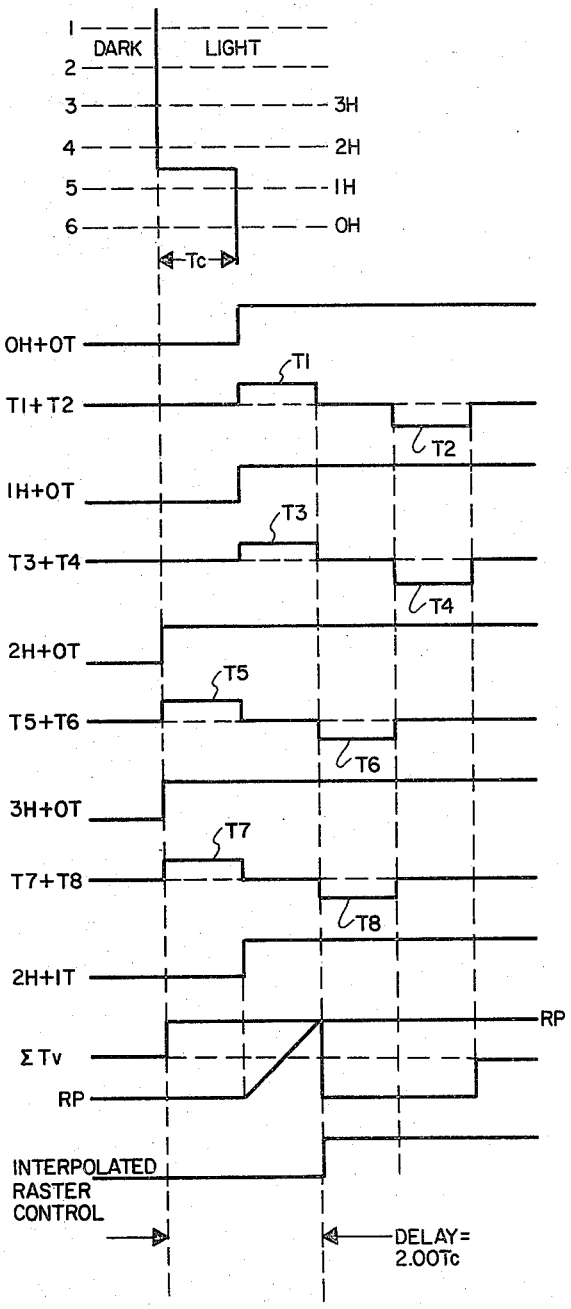
Figure 5D:
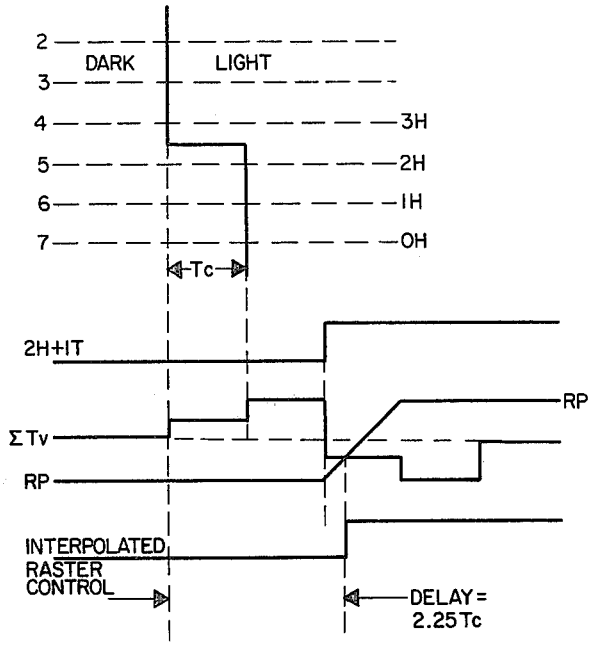
Figure 5E:
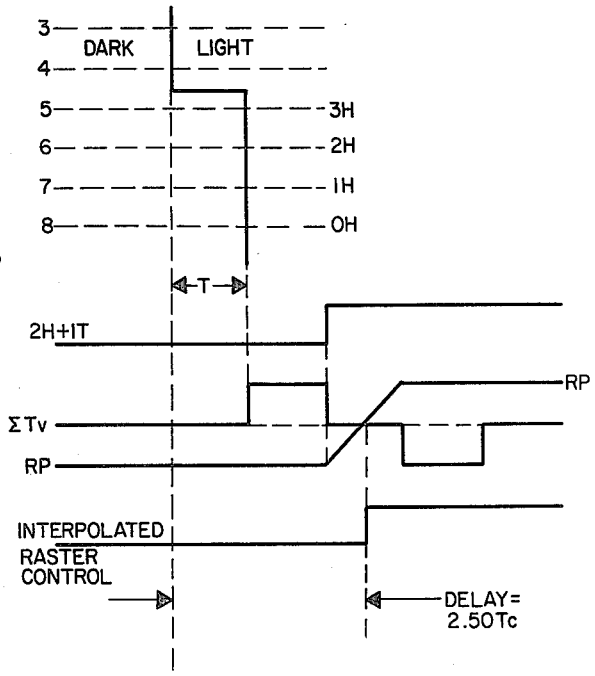
Figure 5F:
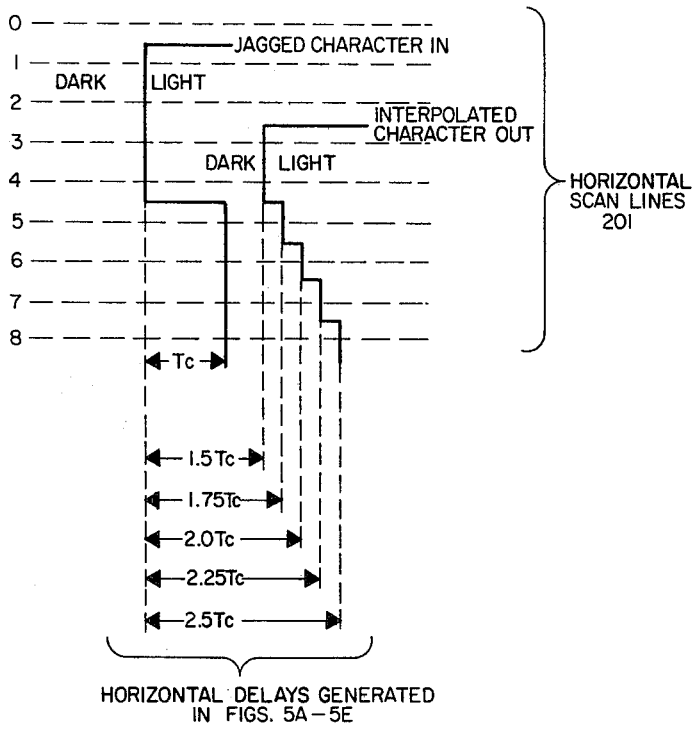
FIG. 5F shows the effect of these key signals and events on the displayed character.

In a similar fashion, FIGS. 5C through 5E trace the key signals that exist as the present raster control signal $\phi H+\phi T$ moves down successive horizontal scan lines. As each of these figures illustrates, the delay that is generated in the interpolated raster control signal 316 progressively increases in increments of $\phi$0.25 $T_c$. This is best illustrated in FIG. 5F, which figure compares the jagged character edge that would appear in the absence of the invention herein disclosed against the interpolated character edge that appears with said invention. As FIG. 5F shows, the interpolated character edge has the same resolution that would be obtained if the character resolution time $T_c$ were decreased by a factor of four.

When a diagonal character edge has one $T_c$ increment for each one, two, or four horizontal scan lines, as most diagonal edges do, the interpolated raster control signal has equal consecutive time steps. This corresponds identically to the output of a hypothetical digital character generator in which $T_c$ has been reduced to zero.

FIG. 5F also shows that the interpolated character would appear delayed from the jagged character by an average of two $T_c$ increments (and two sweep times $T_s$). This delay would cause the interpolated character to appear slightly to the right of and down from where the jagged character would have appeared on the CRT screen. If this slight change in position is undesirable, then it is a simple matter to advance the jagged character signals so that the interpolated signal ultimately appears at the same location on the CRT screen as would the unadvanced jagged character.

The timing sequence signals shown in FIGS. 5A through 5E correspond to a jagged edge that is sloping downwardly to the right. Should the jagged edge slope downwardly to the left, then the resulting waveform sequences are left-to-right symmetrical to those shown in FIGS. 5A through 5E, and can best be visualized by looking at said figures upside down.

Figure 6:
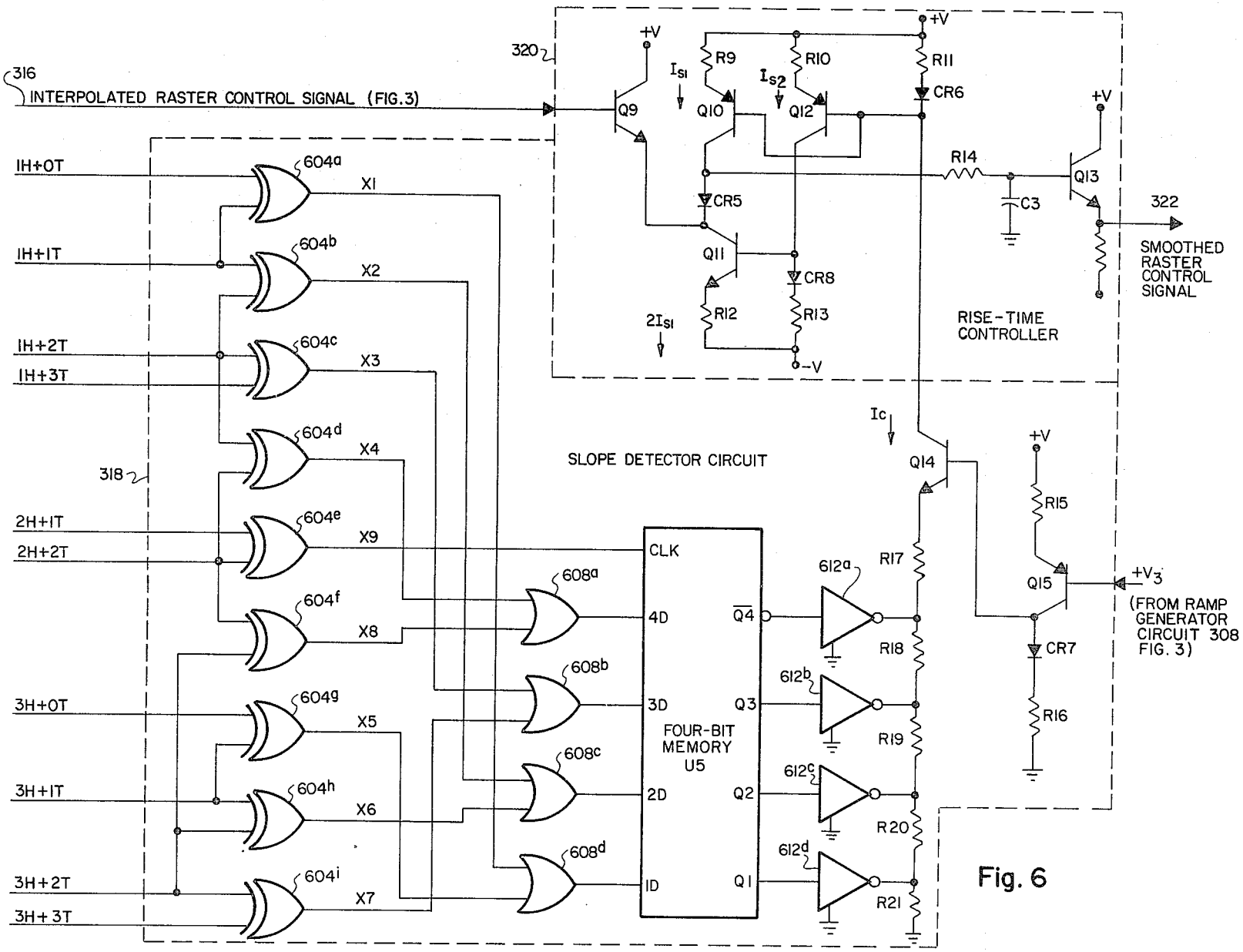
FIG. 6 shows exemplary circuitry for the slope detector 318 and the rise time controller 320 of FIG. 3.

Referring now to FIG. 6, there is shown exemplary circuitry of the slope detector circuit 318 and the rise time controller 320 of FIG. 3. The slope detector circuit 318 consists of transition detector circuits 604*a* through 604*i*, realized by commercially available exclusive-OR gates. Three of these circuits, 604*a*, 604*b*, and 604*c* receive the "1H+mT" signals as inputs, where m=0, 1, 2, 3, in such a fashion that a series of three pulses, $X_1$, $X_2$, $X_3$, each pulse lasting $T_c$ seconds, and each pulse beginning coincident with the end of the prior pulse, is generated for each transition of the 1H+$\phi$T signal. The leading edge of the first pulse, $X_1$, is always coincident with the 1H+$\phi$T transition.

An additional three transition detector circuits, 604*g*, 604*h*, and 604*i*, are similarly connected to receive the 3H+mT signals, m=0, 1, 2, 3, so as to generate a series of three pulses, X5, X6, and X7, with the leading edge of X5 being coincident with the 3H+OT transition.

The last three transition detector circuits, 604*d*, 604*e*, and 604*f*, are used to generate a clock pulse, X9, and two parity signals X4 and X8. The clock pulse X9 is a positive pulse of duration $T_c$ seconds with a leading edge coincident with the 2H+1T transition. The X4 parity signal is high whenever there is a difference between the levels of the 1H+2T and 2H+2T signals. Similarly, the X8 parity signal is high whenever there is a difference between the levels of the 2H+2T and 3H+2T signals.

A four-bit memory U5 (four D-type flip-flops), as well as the equivalent circuitry of four OR gates, 608*a* through 608*d*, and four open-collector inverter gates, 612*a* through 612*d*, also form part of the slope detector circuit 318. If any of the pulses X1, X2, X3, or X5, X6, X7 is high coincident with the leading edge of the clock pulse X9, then a logical one is stored in a corresponding location of the memory U5. For example, a logical one coincident with the leading edge of X9 appearing at either input of gate 608b has the effect of setting the output of the open collector inverter 612b at a logical zero. In effect, this switches the point between resistors R18 and R19 to ground. Similarly, a logical one coincident with the leading edge of X9 appearing at either input of gate 608c switches the point between resistors R19 and R20 to ground. Likewise, the point between resistors R20 and R21 is switched to ground whenever there appears a logical one at either input of gate 608d that is coincident with the leading edge of the clock pulse X9.

The voltage at the base of transistor Q14 is set to a constant reference voltage as determined by the reference voltage $+V_3$ appearing at the base of transistor Q15. That is, transistor Q15, and accompanying circuit components R15, CR7, and R16, serve to buffer the reference voltage $+V_3$ and convert it to a proportional reference voltage that is applied to the base of Q14. This reference voltage in turn sets a constant voltage at the emitter of Q14, which forces a slope detector control current, $I_c$, to flow depending upon the resistance value present between the emitter and ground. That is, $I_c$ is inversely proportional to the total resistance that appears in series before being "switched" to ground. If none of the "switches" 612a–612d are closed, then the largest resistance value is present in the emitter circuit of Q14, R17, R18, R19, R20 and R21. Accordingly, $I_c$ will take on its smallest value. On the other hand, if the "switch" 612a is closed, then only R17 is present in the emitter circuit, and $I_c$ will take on its largest value. For a given application, it may be desirable to make some of the discrete resistor values zero, i.e., R18=R19=0. It may also be desirable to make some of the resistor values equal, i.e., R17=R20=R21. The slope detector control current, $I_c$, corresponds to the rise-time control signal 319 discussed in connection with FIG. 3.

The rise-time controller 320 modifies the rise and fall times of the interpolated raster control signal 316 as a function of the slope detector control current, $I_c$. These rise and fall times are modified in much the same way as the ramp signal is generated by the ramp generator circuit 308. That is, a constant current is forced to flow into or out of a charging capacitor C3. However, in this case, the value of the constant charging current is set by the slope detector control current, $I_c$. As shown in FIG. 6, $I_c$ flows through R11 and CR6 (used to compensate for temperature variations in the base-emitter voltages of transistors Q10 and Q12), thereby causing a reference voltage to appear at the bases of Q10 and Q12. This reference voltage, in turn, forces constant currents, $I_{S1}$ and $I_{S2}$, to flow in the emitters of Q10 and Q12 respectively. Current $I_{S2}$ flows through R13, thereby generating a reference voltage at the base of transistor Q11. The value of emitter resistor R12, connected to Q11, is selected so that the current forced to flow therethrough has a value of $2I_{S1}$. With this arrangement, the rise-time controller 320 ramps the transitions of the interpolated raster control signal 316 according to the same principles discussed in connection with the ramp generator circuit 308. The larger the value of the slope detector control current $I_c$, the greater the value of currents $I_{S1}$ and $I_{S2}$, and the steeper the slope of the ramp signal thus generated. The transistor $Q_{13}$ serves as a buffer stage prior to outputting the smoothed raster control signal 322.

The reference voltage $+V_3$ of the slope detector circuit 318 is also the control voltage for $I_1$ of the ramp generator 308. Thus, charging current $I_{S1}$ of the rise-time controller 320 is proportional to the charging current $I_1$ of the ramp generator 308. Therefore, as R9 of the ramp generator 308 is adjusted to make the time of the ramp RP—RP equal to $T_c$, the output rise-time from the rise-time controller 320 is made proportional to $T_c$ times the total value of resistance appearing between the emitter of Q14 and ground. The object of this is to make this output rise-time proportional to the amount of time (number of $T_c$ increments) from one horizontal scan to the next on a character edge that is oblique to vertical.

Figure 7A:
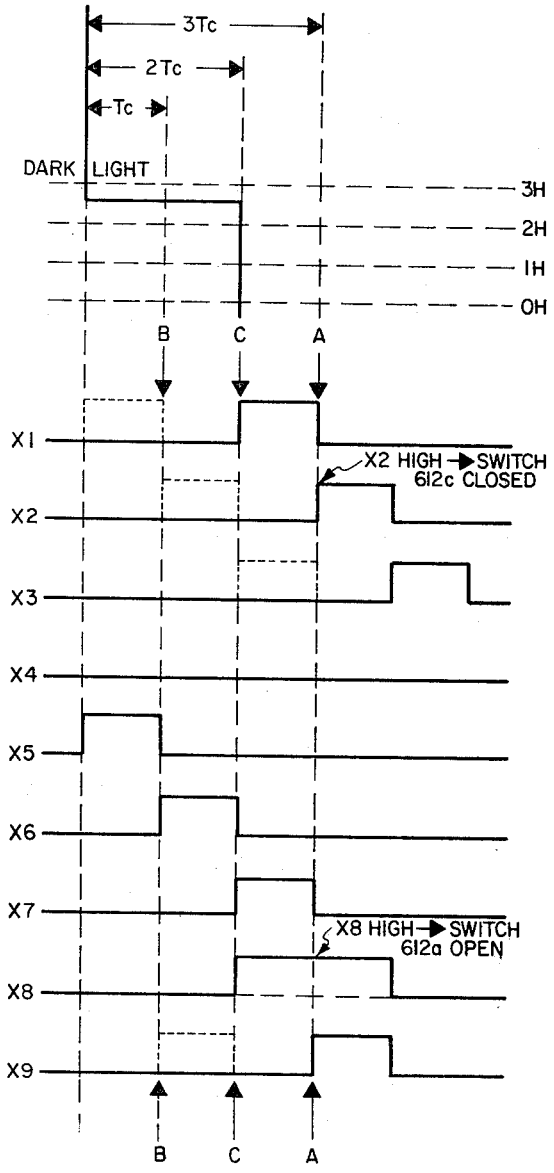
FIGS. 7A through 7C show exemplary timing sequence diagrams that illustrate the order in which key signals and events related to FIG. 6 occur.
Figure 7B:
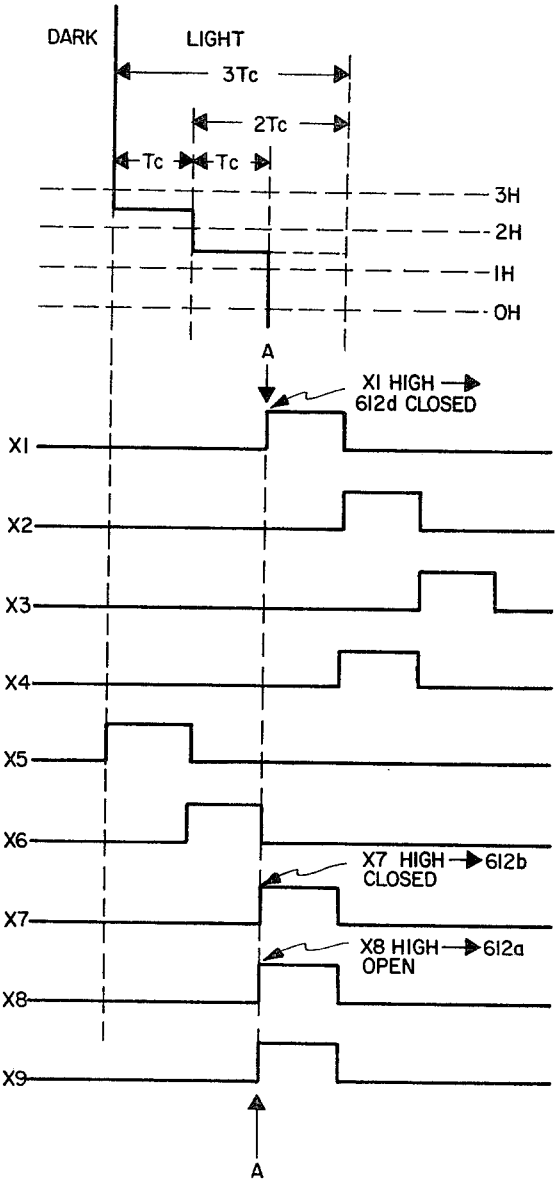
Figure 7C:
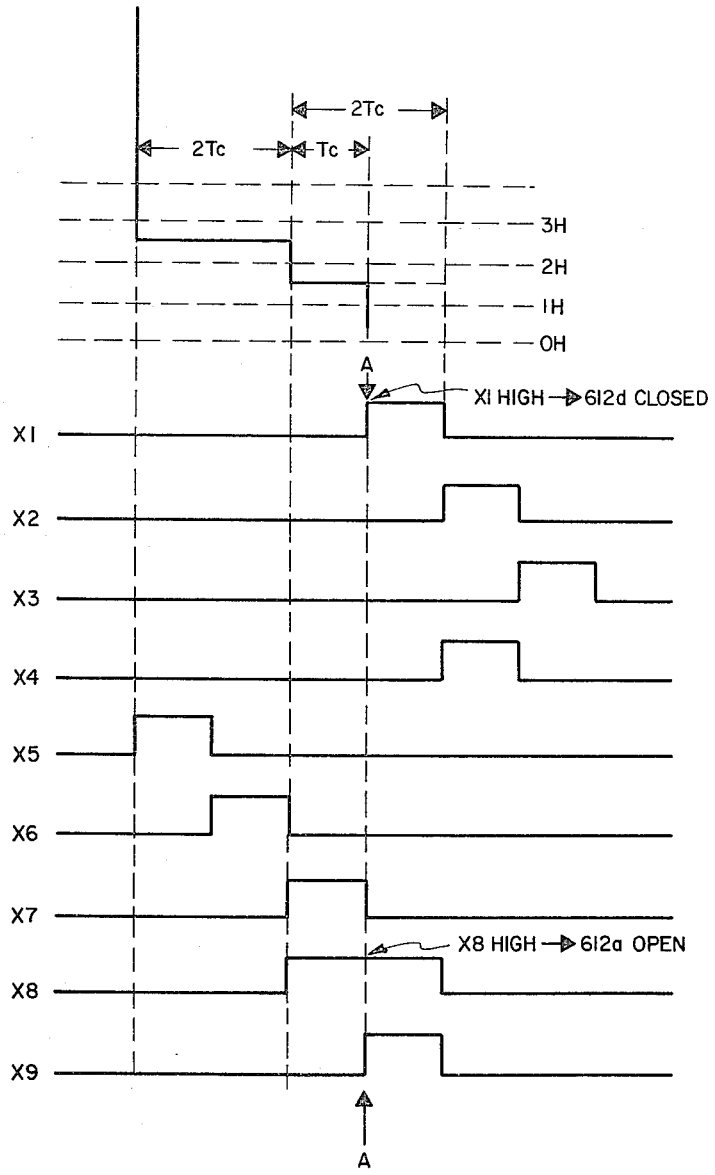

The timing sequence diagrams of FIGS. 7A through 7C illustrate in order in which key signals and events related to the operation of the slope detector circuit 318 occur. First, in FIG. 7A, there is shown a single step of width $2T_c$. At the time shown, the X1, X2, and X3 series of pulses is generated coincident with the leading edge of the 1H+OT signal. Similarly, the X5, X6, and X7 series of pulses is generated coincident with the leading edge of the 3H+OT signal. The parity signal X4 is a low signal the entire time because there is no difference between the 1H+2T and 2H+2T signals. The parity signal X8, however, does show a difference between the 2H+2T and 3H+2T signals. The clock pulse X9 clocks whatever signals are present at its leading edge, indicated by the arrows A—A, into the memory register U5 (FIG. 6) One of these signals is the X8 parity signal. However, the "switch" 612a, unlike the "switches" 612b, 612c, and 612d, is controlled by the inverse of the parity signal stored in memory. Hence, a high signal at either input of 608a opens the "switch" 612a. The only other signal high at the clock time A—A is the X2 signal. X2 is connected as one of the inputs to the OR gate 608c, meaning that the "switch" 612c is closed. Thus, the slope detector control current $I_c$ is set to a value as determined by R17+R18+R19, and a corresponding rise-time is generated by the rise-time controller 320, thus converting the interpolated raster control signal 316 to a smoothed raster control signal 322 (FIG. 6).

The dashed lines shown in FIG. 7A indicate what occurs when there is no step in the edge of the displayed character. In such a case, the leading edge of the clock pulse X9 occurs at time B—B. But because neither parity signal, X4 nor X8, is high at this or any other time, the "switch" 612a will be closed, thus forcing the largest value of slope detector control current $I_c$ and the steepest possible rise time on the smoothed raster control signal 322.

FIG. 7A may also be used to illustrate what happens for other single steps of various widths. For example, if the jagged edge were of width $T_c$, then it's not too difficult to see that the clock time would occur at the time C—C, and X8, X7, and X2 would all be high at the time. X8 would hold "switch" 612a open; X7 would close "switch" 612b; and X2 would close "switch" 612c. However, the closing of "switch" 612b would nullify any significant effect created by the closing of switch 612c. Thus, the slope detector control current $I_c$ would be inversely proportional to the value of R17 and R18, and the resulting rise-time would be somewhat steeper than was the case for a jagged step of width $2T_c$, considered earlier.

FIG. 7B illustrates the same signals for a first step of the jagged edge of width $T_c$, followed by a second step of the jagged edge of various widths. For the condition shown in the solid lines, i.e., two steps of width $T_c$, it is seen that the controlling "switch" closed is 612*b*. Hence, a fairly steep rise time will appear on the smoothed raster control signal 322.

FIG. 7C shows these same signals for a first step of the jagged edge of width $2T_c$, followed by a second step of various widths. For the condition shown in the solid line, i.e., a step of $2T_c$ followed by a step of $T_c$, only the X1 pulse is high at the clock time A—A (other than the parity signal X8). Hence, "switch" 612*d* is closed and the slope detector control current is inversely proportional to R17+R18+R19+R20. Accordingly, the resulting rise time that is generated by the rise-time controller 320 is the longest rise-time of the conditions considered thus far.

For a first jagged edge of width $2T_c$ followed by a second jagged edge of width of $2T_c$, FIG. 7 can be used to show that none of the pulses would be high at the clock time A—A (other than the X8 parity signal). Thus, no "switches" are closed, and the control current $I_c$ assumes its smallest possible value, resulting in the longest possible rise time on the smoothed raster control signal 322.

FIGS. 7A through 7C represent the key signals obtained for transitions moving in stair-step fashion towards the lower right. Similar signals are obtained for transitions moving in stair-step fashion towards the upper right, except that parity signal X4, and transition signals X5, X6 and X3, generally control the "switches" which are closed, rather than the signals X8, X2, X1, and X7 as shown in FIGS. 7A through 7B.

For transitions from light to dark, identical signals are obtained. The only difference is that the slope detector control current $I_c$ thus generated sets the fall time of the interpolated raster control signal 316 rather than its rise time.

While the invention herein disclosed has been described by means of a specific embodiment and application thereof, there are numerous modifications and variations thereof which could be made by those skilled in the art. It is therefore to be understood that within the scope of the appended claims, the invention may be practiced otherwise than as specifically described herein.

What is claimed is:

1. A character smoother apparatus for use in a display system or the like which incorporates horizontal timing signals to sweep and return a scanning beam or the like within a time $T_s$ horizontally across a display screen along one of a plurality of horizontal scan lines, vertical timing signals to position the beam vertically at the beginning of an appropriate horizontal scan line, and character generation circuitry to generate a raster control signal that inhibits the sweeping beam in time increments of $T_c$ and in a patterned sequence to form characters on the screen, $T_c$ being the character resolution time, said character smoother apparatus comprising vertical delay means for delaying said raster control signal one or more time periods $T_s$ to produce as first output signals a plurality of delayed raster control signals;

horizontal delay means for delaying said raster control signal and said first output signals for periods of time corresponding to $T_c$ or an integral multiple thereof to produce a plurality of second output signals; and interpolation means for combining said first and second output signals and said raster control signal to produce an interpolated raster control signal that is resolved in time increments which are less than $T_c$, said interpolation means including transition detector means for generating a first transition indicator signal for each positive transition (beam not inhibited) of said raster control signal, said first output signals, and said second output signals, and a second transition indicator signal for each negative transition (beam inhibited) of said raster control signal, said first output signals, and said second output signals;

summing means for combining said first transition indicator signals with said second transition indicator signals to produce a composite transition indicator signal representing the net sum of all transitions, positive transitions adding and negative transitions subtracting, occurring in said raster control signal and said first and second output signals at a given $T_c$ increment;

ramp generating means for generating a positive going ramp signal that starts at a minimum voltage level and increases in a certain time to a maximum voltage level for each positive transition (beam not inhibited) of one of said second output signals, and a negative going ramp signal that starts at said maximum voltage level and decreases in said certain time to said minimum voltage level for each negative transition (beam inhibited) of said second output signal; and comparator means for comparing said composite transition indicator signal with said positive or negative going ramp signal and for producing an interpolated raster control signal that is high (beam not inhibited) whenever said ramp signal is a higher level than said composite transition indicator signal, and low (beam inhibited) whenever said ramp signal is a lower level than said composite transition indicator signal, said interpolated raster control signal thus being resolved in time increments which are less than $T_c$.

2. A character smoother apparatus as in claim 1 wherein said interpolation means further comprises clipping means to limit said composite transition indicator signal to maximum and minimum voltage levels.

3. A character smoother apparatus as in claim 1 wherein said transition detector means comprises circuitry for generating a tri-level signal, which appears on an output signal line, said tri-level signal comprising a positive pulse followed by a negative pulse for each positive transition (beam not inhibited) of said raster control signal, said first output signals, and said second output signals, said positive-negative pulse combination constituting said first transition indicator signal, and a negative pulse followed by a positive pulse for each negative transition (beam inhibited) of said raster control signal, said first output signals, and said second output signals, said negative-positive pulse combination constituting said second transition indicator signal.

4. A character smoother apparatus as in claim 3 wherein said circuitry for generating a tri-level signal comprises one or more groups of resistor networks, each group comprising two sets of two resistors connected in tandem, a first set of said networks having one end thereof connected to said raster control signal or said first output signals, and having the other end connected to a signal that is the inverse of a signal delayed a time $T_c$ from said raster control signal or said first output signals, and a second set of said networks having one end thereof connected to a signal that is the inverse of a signal delayed a time $2T_c$ from said raster control signal or said first output signals, and having the other end connected to a signal delayed a time $3T_c$ from said raster control signal or said first output signals; and signal means interconnecting the midpoint of said groups of resistor networks to form a single tie point which serves as the output signal line on which said tri-level signal appears.

5. A character smoother apparatus as in claim 3 wherein said summing means comprises analog circuitry for summing said first transition indicator signal and said second transition indicator signal, said analog circuitry including a constant voltage source for applying a voltage signal to the output signal line of said transition detector means;

a fixed summing resistor;

a constant current source for producing a constant current that is shared between said constant voltage source and said fixed summing resistor; and means for sensing the voltage that is produced across said fixed summing resistor by that portion of said constant current flowing therethrough.

6. A character smoother apparatus for use in a display system or the like which incorporates horizontal timing signals to sweep and return a scanning beam or the like within a time $T_s$ horizontally across a display screen along one of a plurality of horizontal scan lines, vertical timing signals to position the beam vertically at the beginning of an appropriate horizontal scan line, and character generation circuitry to generate a raster control signal that inhibits the sweeping beam in time increments of $T_c$ and in a patterned sequence to form characters on the screen, $T_c$ being the character resolution time, said character smoother apparatus comprising vertical delay means for delaying said raster control signal one or more time periods $T_s$ to produce as first output signals a plurality of delayed raster control signals;

horizontal delay means for delaying said raster control signal and said first output signals for periods of time corresponding to $T_c$ or an integral multiple thereof to produce a plurality of second output signals;

interpolation means for combining said first and second output signals and said raster control signal to produce an interpolated raster control signal that is resolved in time increments which are less than $T_c$;

slope detection means for sampling said first and second output signals to determine the amount of slope that would appear in the pattern displayed on the screen between the time the raster control signal inhibits or does not inhibit the beam on one horizontal scan line and the time said raster control signal inhibits or does not inhibit the beam on an adjacent or subadjacent horizontal scan line, and for generating a rise-time control signal that is a function of this detected slope; and rise-time control means responsive to said rise-time control signal for controlling the rise time of said interpolated raster control signal to produce a smoothed interpolated raster control signal which gradually turns said beam on and off, giving the subjective appearance of smoothed diagonal lines on characters displayed on the screen.

7. A character smoother apparatus as in claim 6 wherein said slope detection means comprises first pulse generating means for generating a delayed transition pulse for each transition of said first output signals which are delayed n and n+2 periods $T_s$ from said raster control signal by said vertical delay means; where n is an integer;

second pulse generating means for generating additional delayed transition pulses for each transition of said second output signals which are delayed an integral number of time increments $T_c$ by said horizontal delay means from those first output signals that are delayed n and n+2 periods $T_s$ from said raster control signal;

clock means for generating a clock pulse that is delayed $2T_s$ time periods from said raster control signal plus a fixed integral number of time increments $T_c$; and storage means for storing said delayed transition pulses that are coincident with said clock pulse, thereby providing in storage a number of delayed transition pulses that represents a measure of the length of time between when said beam is inhibited or not inhibited on a first horizontal scan line and when said beam is inhibited or not inhibited two horizontal scan lines later.

8. A character smoother apparatus for use in a display system or the like which incorporates horizontal timing signals to sweep and return a scanning beam or the like within a time $T_s$ horizontally across a display screen along one of a plurality of horizontal scan lines, vertical timing signals to position the beam vertically at the beginning of an appropriate horizontal scan line, and character generation circuitry to generate a raster control signal that inhibits the sweeping beam in time increments of $T_c$ and in a patterned sequence to form characters on the screen, $T_c$ being the character resolution time, said character smoother apparatus comprising vertical delay means for delaying said raster control signal one or more time periods $T_s$ to produce as first output signals a plurality of delayed raster control signals;

horizontal delay means for delaying said raster control signal and said first output signals for periods of time corresponding to $T_c$, or integral multiples thereof, to produce a plurality of second output signals;

slope detection means for sampling said first and second output signals to determine the amount of slope that would appear in the pattern displayed on the screen between the time the raster control signal inhibits or does not inhibit the beam on one horizontal scan line, and the time said raster control signal inhibits or does not inhibit the beam or an adjacent or sub-adjacent horizontal scan line and for generating a rise-time control signal that is a function of this detected slope; and rise-time control means responsive to said rise-time control signal for controlling the rise time of the raster control signal to produce a smoothed raster control signal which gradually turns said beam on and off, giving the subjective appearance of smoothed diagonal lines on characters displayed on the screen.

9. A CRT character smoother method for smoothing CRT characters displayed on a CRT screen, said CRT display being controlled by a horizontal timing signal which sweeps and returns an electron beam across the inside face of the CRT along a horizontal scan line in $T_s$ seconds, and by a vertical timing signal which positions the electron beam vertically at the beginning of a different horizontal scan line before each sweep, and said characters being generated by a character generation circuit, which circuit produces a raster control signal that inhibits the sweeping electron beam in a patterned sequence at fixed intervals of $T_c$ seconds, where $T_c$ is termed the character resolution time, said method for smoothing characters comprising the steps of delaying said raster control signal for a period of time $T_s$ and integral multiples thereof to thereby produce one or more first delayed signals as outputs;

delaying said raster control signal and said first delayed signals for a period of time $T_c$ and integral multiples thereof to produce a plurality of second delayed signals as outputs;

combining said first and second delayed signals, thereby producing a delayed interpolated raster control signal that is resolved in time increments which are less than $T_c$, wherein the step of combining said first and second delayed signals comprises generating from said raster control signal a three-level signal that, for each positive transition of said raster control signal, contains in sequence a pulse having a first polarity, a delay of $T_c$ seconds, and a pulse having a second polarity, and that, for each negative transition of said same signal, contains in sequence a pulse having a second polarity, a delay of $T_c$ seconds, and a pulse having a first polarity;

generating a similar three-level signal for each positive or negative transition occurring in said first or second delayed signals;

adding said three-level signals in analog fashion to produce a composite stair-step signal;

clipping said composite stair-step signal to maximum positive and negative levels;

generating a ramp signal beginning $kT_s+pT_c$ period of time after a transition occurs in said raster control signal, where k and p are fixed integers, and ending $kT_s+(p+1)\ T_c$ period of time thereafter, said ramp signal being positive going if a positive transition occurs in said raster control signal and negative going if a negative transition occurs in said same signal; and comparing the voltage of said ramp signal with that of said clipped stair-stepped signal and generating a two level interpolated raster control signal that is low when said ramp signal is less than said clipped stair-stepped signal, high when said ramp signal is greater than said clipped stairstepped signal, and whose transitions from high to low, or low to high, may begin at times other than increments of $T_c$.

10. A method for smoothing CRT characters as in claim 9 wherein the steps of delaying said raster control signal to produce said first and second delayed signals comprises delaying said raster control signal for combinations of $T_c$ and $T_s$ time periods, thereby producing delayed raster control signals of $T_c$, $2T_c$, . . . $nT_c$ seconds, $T_s$, $T_s+T_c$, $T_s+2T_c$, . . . $T_s+nT_c$ seconds, $2T_s$, $2T_s+T_c$, $2T_s+2T_c$, . . . $2T_s+nT_c$ seconds, . . . and $mT_s$, $mT_s+T_c$, $mT_s+2T_c$, . . . $mT_s+nT_c$ seconds, where m and n are integers greater than zero.

11. A method for smoothing CRT characters displayed on a CRT screen, said CRT display being controlled by a horizontal timing signal which sweeps and returns an electron beam across the inside face of the CRT along a horizontal scan line in $T_s$ seconds, and by a vertical timing signal which positions the electron beam vertically at the beginning of a different horizontal scan line before each sweep, and said characters being generated by a character generation circuit, which circuit produces a raster control signal that inhibits the sweeping electron beam in a patterned sequence at fixed intervals of $T_c$ seconds, where $T_c$ is termed the character resolution time, said method for smoothing characters comprising the steps of delaying said raster control signal for a period of time $T_s$ and integral multiples thereof to thereby produce one or more first delayed signals as outputs;

delaying said raster control signal and said first delayed signals for a period of time $T_c$ and integral multiples thereof to produce a plurality of second delayed signals as outputs;

combining said first and second delayed signals, thereby producing a delayed interpolated raster control signal that is resolved in time increments which are less than $T_c$, and controlling the rise and fall time of said delayed interpolated raster control signal as a function of the slope of the character edge to be displayed, a steep slope causing said rise and fall times to be very abrupt, and a gradual slope causing said rise and fall times to be very slow.

12. A method for smoothing CRT characters as in claim 11 wherein the step of controlling the rise and fall time of said delayed interpolated raster control signal comprises measuring the number of $T_c$ increments between the time the electron beam is inhibited or not inhibited by said raster control signal on one horizontal scan line and the time the electron beam is correspondingly inhibited or not inhibited on an adjacent or sub-adjacent horizontal scan line;

generating a rise-time control signal which represents said measurement; and smoothing the rise and fall times of said delayed interpolated raster control signal in proportion to said rise-time control signal, thereby producing a smoothed raster control signal which turns the sweeping electron beam of said CRT display on and off gradually or abruptly, depending upon whether that portion of the character being displayed on the present adjacent and sub-adjacent horizontal scan lines contains a sloping or vertical edge respectively.

13. A CRT character smoother method for smoothing CRT characters displayed on a CRT screen, said CRT display being controlled by a horizontal timing signal which sweeps and returns an electron beam across the inside face of the CRT along a horizontal scan line in $T_s$ seconds, and by a vertical timing signal which positions the electron beam vertically at the beginning of a different horizontal scan line before each sweep, and said characters being generated by a character generation circuit, which circuit produces a raster control signal that inhibits the sweeping electron beam in a patterned sequence at fixed intervals of $T_c$ seconds, where $T_c$ is termed the character resolution time, said method for smoothing characters comprising the steps of delaying said raster control signal for a period of time $T_s$ and integral multiples thereof to thereby produce one or more first delayed signals as outputs;

delaying said raster control signal and said first delayed signals for a period of time $T_c$, and integral multiples thereof, to produce a plurality of second delayed signals as outputs;

producing a delayed raster control signal from one of said second delayed signals;

measuring the number of $T_c$ increments between the time the electron beam is inhibited or not inhibited by said raster control signal on one horizontal scan line and the time the electron beam is correspondingly inhibited or not inhibited or an adjacent or sub-adjacent horizontal scan line, said measurement being facilitated by a comparison of said raster control signal, said first delayed signals, and said second delayed signals;

generating a rise-time control signal which represents said measurement;

smoothing the rise and fall times of said delayed raster control signal in proportion to said rise-time control signal, thereby producing a smoothed raster control signal; and using said smoothed raster control signal to turn the sweeping electron beam of said CRT display on and off gradually or abruptly, depending upon whether that portion of the character being displayed on the adjacent and sub-adjacent horizontal scan lines contains a sloping or vertical edge respectively.

* * * * *